US009157434B2

(12) United States Patent
Leonard et al.

(10) Patent No.: US 9,157,434 B2
(45) Date of Patent: Oct. 13, 2015

(54) SUMP PUMP SYSTEM WITH AUTOMATED SYSTEM MONITORING AND DATA COLLECTION

(71) Applicant: PumpSpy Technology, LLC, Avon, OH (US)

(72) Inventors: Jeffrie J Leonard, Westlake, OH (US); Joseph K Mauro, Sr., Richland, MI (US)

(73) Assignee: PUMPSPY TECHNOLOGY, LLC, Avon, OH (US)

( * ) Notice: Subject to any disclaimer, the term of this patent is extended or adjusted under 35 U.S.C. 154(b) by 162 days.

(21) Appl. No.: 14/160,692

(22) Filed: Jan. 22, 2014

(65) Prior Publication Data

US 2014/0202243 A1 Jul. 24, 2014

Related U.S. Application Data

(60) Provisional application No. 61/755,026, filed on Jan. 22, 2013.

(51) Int. Cl.

| | |
|---|---|
| ***G05D 16/00*** | (2006.01) |
| ***G01F 1/00*** | (2006.01) |
| ***F04B 51/00*** | (2006.01) |
| ***F04B 23/02*** | (2006.01) |
| ***F04B 23/04*** | (2006.01) |
| ***F04B 49/06*** | (2006.01) |

(52) U.S. Cl.

CPC ..... *F04B 51/00* (2013.01); *F04B 23/021* (2013.01); *F04B 23/04* (2013.01); *F04B 49/06* (2013.01)

(58) Field of Classification Search

None

See application file for complete search history.

(56) References Cited

U.S. PATENT DOCUMENTS

| | | | | |
|---|---|---|---|---|
| 4,369,438 | A * | 1/1983 | Wilhelmi | H04M 11/04 340/521 |
| 8,600,568 | B2 * | 12/2013 | Smaidris | C02F 1/008 137/101.19 |
| 8,983,667 | B2 * | 3/2015 | Smaidris | C02F 1/006 137/101.19 |
| 2006/0045105 | A1 * | 3/2006 | Dobosz | H04L 12/2803 370/401 |
| 2007/0251461 | A1 * | 11/2007 | Reichard | A01K 63/006 119/245 |
| 2010/0135823 | A1 * | 6/2010 | Andy | E03F 5/22 417/12 |
| 2015/0143892 | A1 * | 5/2015 | Cummings | F04D 13/08 73/168 |

* cited by examiner

*Primary Examiner* — Peter Macchiarolo
*Assistant Examiner* — Jermaine Jenkins
(74) *Attorney, Agent, or Firm* — Cooper Legal Group, LLC

(57) ABSTRACT

A method of operation analysis of operation of a plurality of sump pumps located at various, separate locations. A plurality of sensors are respectively associated therewith. Each sensor sensing at least one operation condition. A plurality of location communication devices are respectively associated therewith. A master communicating device is located away from the separate locations. The communicated information is received at the master communicating device. The received communicated information is stored in memory. At least one benchmark value is determined concerning an operating condition utilizing the received information for each of the plurality of sump pumps. The received information for each of the sump pumps is compared to the benchmark value. Each sump pumps based is classified based upon each respective comparison.

17 Claims, 5 Drawing Sheets

SUMP PUMP SYSTEM WITH AUTOMATED SYSTEM MONITORING AND DATA COLLECTION

RELATED APPLICATIONS

This application claims the benefit of U.S. Provisional Application No. 61/755,026, filed on Jan. 22, 2013, the entire disclosure of which is hereby incorporated herein by reference.

BACKGROUND OF THE INVENTION

1. Field of the Invention

The present invention relates generally to a sump pumps.

2. Discussion of the Prior Art

Sump pump are used for the removing water that enters into a building such as a dwelling. As can be appreciated, proper and timely operation of a sump pump can be of great importance so as to avoid damage that might otherwise be caused by the water entering into a building.

Often, sump pumps are provided so as to be operational via consumption of AC current and operational via consumption of DC current (i.e., via a back-up battery). The AC current can be considered to be primary power and the DC current can be considered to be back-up power. The primary power and the back-up power could be utilized to operate a single sump pump. Alternatively, the primary power could be supplied to a first, primary sump pump and the and back-up power could be supplied to a second, back-up sump pump. To be sure, the provision of back-up power and/or a second, back-up sump pump are logical to help ensure the proper and timely operation of a sump pump so as to avoid damage that might otherwise be caused by the water entering into a building.

Associated with a sump pump arrangement within a building is typically a sensor and alarm arrangement. The sensor senses an undesirable condition (e.g., a water level above a predefined level indicating a sump pump failing to accomplish the task of removing water that enters into the building so as to avoid damage that might otherwise be caused) and causes the alarm to activate (i.e., emit an alarm sound) within the building. Such, provides notice to persons present within the building that attention to the sump pump may be needed.

Also, it is possible to include a remote monitoring arrangement to a sump pump arrangement within a building. The remote monitoring arrangement again includes a sensor that senses an undesirable condition (e.g., a water level above a predefined level indicating a sump pump failing to accomplish the task of removing water that enters into the building so as to avoid damage that might otherwise be caused). However, in lieu of or in addition to local alarm activation (i.e., emit an alarm sound) within the building, the remote monitoring arrangement transmits the "alarm" indication external to the building. The alarm transmission may be via a telephone line transmission or a cellular transmission to a monitoring company. In turn, the monitoring company can contact an owner or other responsible person concerning the "alarm" condition that has occurred at the building. As can be appreciated, providing such an "alarm" condition, while good and useful, is an indication of a potentially adverse situation that has already occurred. Also, as can be appreciated, contacting an owner or other responsible person concerning the "alarm" condition that has occurred at the building, while good and useful, may further expend time and again is only an indication of a potentially adverse situation that has already occurred. Accordingly, there is a continuing need for improvements in the field of sump pumps.

BRIEF DESCRIPTION OF THE INVENTION

The following presents a simplified summary of the invention in order to provide a basic understanding of sonic example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, the present invention provides a method of operation analysis of operation of a plurality of sump pumps. The plurality of sump pumps are located at various, separate locations. A plurality of sensors are respectively associated with the plurality of sump pumps at the separate locations. Each sensor sensing at least one operation condition of the respective sump pump. A plurality of location communication devices are respectively associated with the plurality of the sump pumps and the sensors at the separate locations. Each location communication device communicates information regarding the sensed at least one operating condition of the respective sump pump. The method includes providing a master communicating device located away from the separate locations. The method includes receiving the communicated information regarding the sensed at least one operating condition of each of the plurality of sump pumps at the master communicating device. The method includes storing the received communicated information for each of the plurality of sump pumps in memory. The method includes determining at least one benchmark value concerning the at least one operating condition utilizing at least most of the received communicated information for each of the plurality of sump pumps. The method includes comparing the received communicated information for each of the plurality of sump pumps to the at least one benchmark value. The method includes classifying each of the plurality of sump pumps based upon each respective comparison.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
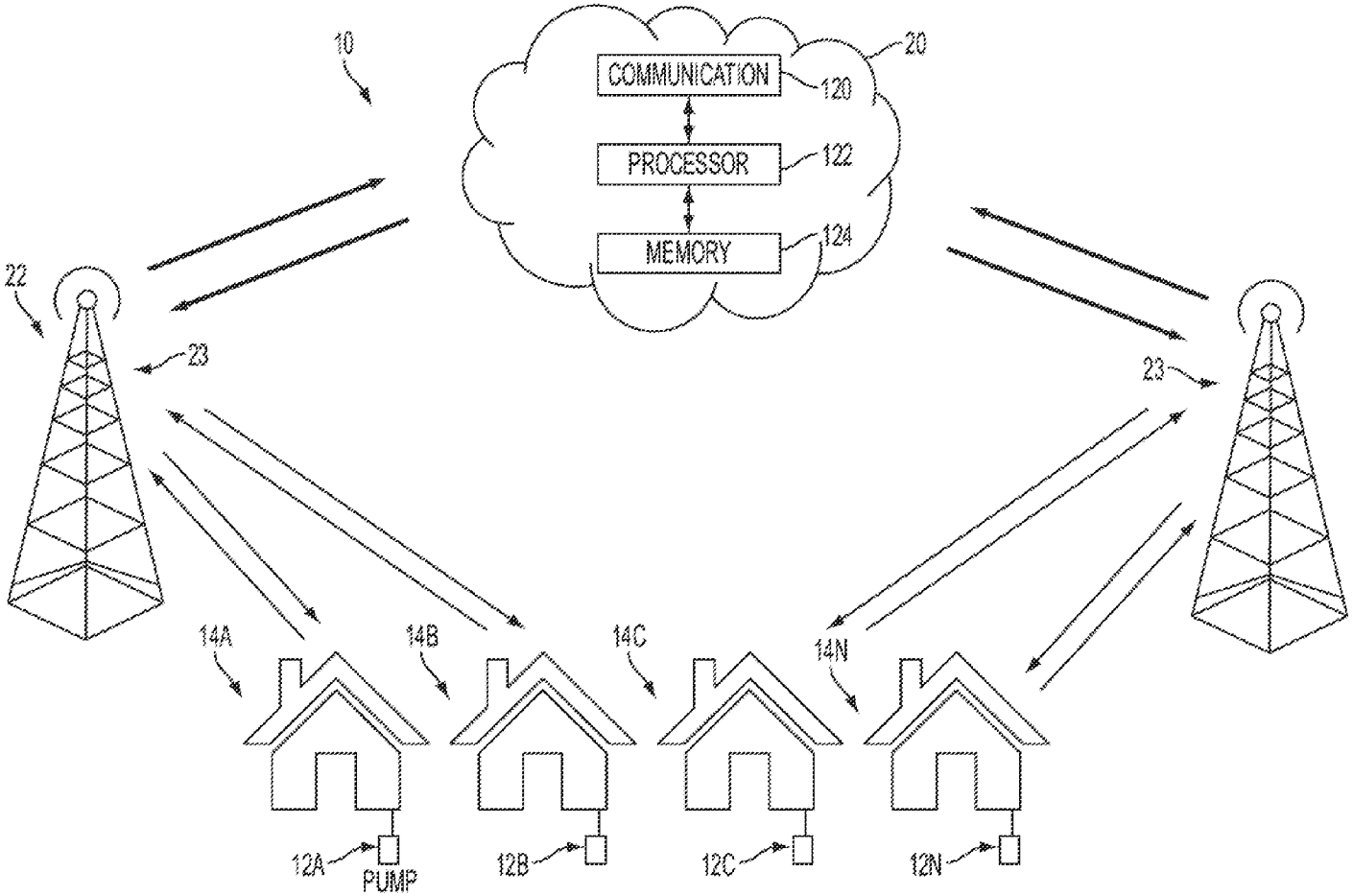
FIG. 1 is a schematic illustration of an example of an automated system monitoring and data collection arrangement for sump pump systems in accordance with an aspect of the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Referring to FIG. 1, an example automated system monitoring and data collection arrangement 10 for sump pump systems 12A-12N is schematically illustrated. It is to be noted that herein the alphabetic suffix "N" is to represent any plural number, and may represent a large number. Only four sumps pumps and four associated buildings are shown, but the present invention is not limited to just that number and any plural number can be utilized. The plurality of sump pump systems 12A-12N are each located within a plurality of buildings (e.g., dwelling houses) 14A-14N. As will be described later, each of the plurality of sump pump systems (e.g., 12A) provides a sump pump function (i.e., removing water that enters into the respective building, e.g., 14A) so as to avoid damage that might otherwise be caused by the water. Also as will be described later, the each of the plurality of sump pump systems (e.g., 12A) provides sensory and remote communication functions. The plurality of buildings 14A-14N are at various and spaced locations (i.e., remote). Thus, the sump pump systems 12A-12N are at various and spaced locations (i.e., remote).

The automated system monitoring and data collection arrangement 10 includes a master (e.g., main, host) device 20 that is located away from the separate locations of the sump pump systems 12A-12N/buildings 14A-14N. As will be described later, the master device 20 provides a remote communication function and data handling and processing (e.g., storage, analysis, etc.) functions. It is to be appreciated that the master device is schematically represented via a "cloud" within FIG. 1 to indicate that with respect to the sump pump systems 12A-12N/buildings 14A-14N, the operations that take place within the master device are occurring virtual or within the "cloud." The automated system monitoring and data collection arrangement 10 includes or utilizes a communication arrangement (e.g., communication link) 22 for communication between the sump pump systems 12A-12N and the master device 20. It is to be appreciated that communication arrangement 22 may be varied. For example, the communication arrangement 22 may include the use of existing, third party cellular telephone system(s). FIG. 1 shows such an example. It is to be appreciated that the example of FIG. 1 schematically shows the communication arrangement 22 via two cellular transmission towers 23. It is to be appreciated that the communication arrangement 22 can include many other structures and/or features (e.g., more cellular transmission towers communicating with various other, different the sump pump systems 12A-12N/buildings 14A-14N, communication relays, and the like).

It is to be appreciated that various, different communication arrangements are contemplated. For example, the communication arrangement 22 may include the use of a third party wired telephone and/or internet system(s). As another example, the communication arrangement 22 may include a different (e.g., different than cellular) spatial transmission arrangement. As still a further example, the communication arrangement 22 may include direct communication (e.g., radio transmission) between the sump pump systems 12A-12N and the master device 20. The generic nature of the communication arrangement 22 is to be appreciated via the directional arrowheads within FIG. 1, which connotes the concept of commutation ultimately between the sump pump systems 12A-12N and the master device 20 regardless of the presence/absence of specific devices there between and relaying such communication. As such the present examples need not be specific limitations.

Figure 2:
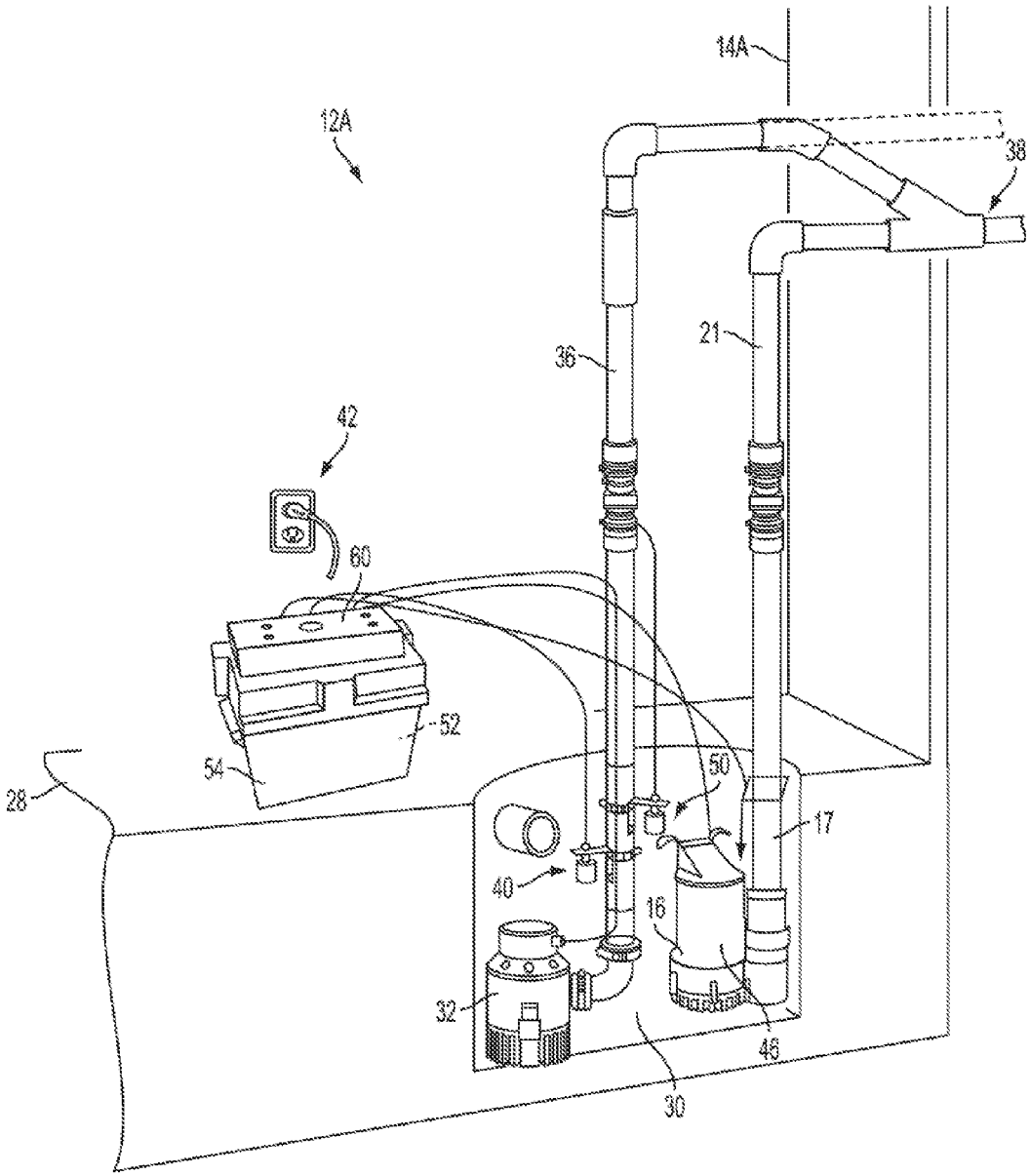
FIG. 2 is a schematic illustration of an example sump pump system within a building.

Turning to FIG. 2, one example of a sump pump system (e.g., 12A) is shown. It is to be appreciated that the shown example need not necessarily be a limitation upon the present invention. Also, it is to be appreciated that the shown example sump pump system (e.g., 12A) can be representative of any or all of the sump pump systems 12A-12N. As such, it is to be appreciated that the descriptions provided for the example can be applicable to any or all of the sump pump systems 12A-12N. Also, the one or more of the sump pump systems 12A-12N could be generically referenced by a generic identification of sump pump system and/or generic reference numeral 12.

The example sump pump system 12A is provided within one of the buildings (e.g., 14A). In one example, the building can be a residential dwelling. Typically, the sump pump system 12A is located at a lower portion 28 (e.g., a basement, cellar, crawl space or the like) of the building 14A. However. location need not be a limitation. Typically, the lower portion (e.g., a basement, cellar, crawl space or the like) contains a crock or basin 30 to collect water. However, a presence of a crock or basin 30 need not be a limitation.

The example sump pump system 12A includes a first sump pump 32, located within the crock 30 and in fluid communication with piping 36 of a piping system 38. The piping system 38 extends to a suitable water discharge point (e.g., sewer connection, exterior water discharge, or the like). The first sump pump 32 is electrically operable. Within one example, the first sump pump 32 is operable via AC (e.g., typical household, line) electricity. Associated with the first sump pump 32 is at least one activation sensor switch 40 which causes activation of the first sump pump for operation when the at least one activation sensor switch determines (e.g., senses) the presence of water sufficient to deem operation of the first sump pump to be needed to pump the water through the piping system 38 to the suitable water discharge point. The building 14A provides the supply of AC (e.g., typical household, line) electricity as is represented by the shown electrical outlet 42.

The shown example sump pump system 12A includes a second sump pump 46, located within the crock 30 and in fluid communication with a pipe 48 of the piping system 38. The second sump pump 46 is electrically operable. Within one example, the second sump pump 46 is operable via DC (e.g., 12 volt DC) electricity. Associated with the second sump pump 46 is at least one activation switch 50 which causes activation of the second sump pump for operation when the at least one activation switch determines (e.g., senses) the presence of water sufficient to deem operation of the second sump pump to be needed to pump the water through the piping system 38 to the suitable water discharge point. It is to be appreciated the shown example sump pump system 12 includes a battery 52 (e.g., 12 volt battery) for providing the supply of DC (e.g., 12 volt DC) electricity. The battery 52 is within a battery box 54 within the example. As will be appreciated, the sump pump system 12 can include suitable charging equipment to maintain charge of the battery via the AC (e.g., typical household, line) electricity. Accordingly, the second sump pump 46 and associated battery 52 can be considered as providing a "battery back-up."

It is to be appreciated that the aspect of battery back-up can be provided in other, different approaches. For example, only a single pump operable via either AC or DC could be provided. Power from the battery 52 could be provided as appropriate (e.g., converted as needed) in the event of loss of household power. As such, the specific pump and electricity supply arrangement need not be a specific limitation. Also, although the second sump pump 46 can be considered to be a battery back-up, it is to be appreciated that the second sump pump could be otherwise operational as a functional back-up to the first sump pump 32 (i.e., the first sump pump is somehow rendered inoperable). Still further, the second sump pump 46 could be configured and/or operated so as to provide contemporaneous assistance to the first sump pump 32 concerning the task of pumping the water through the piping system 38 to the suitable water discharge point. It is to be appreciated that the various configurations and operations need not be specific limitations.

The sump pump system 12A includes a controller 60 located within the building 14A and typically located near the crock/pump(s) location. The controller 60 is electrically connected to the AC (e.g., typical household, line) electricity via the outlet 42 and as such receives electrical power therefrom. The controller 60 is electrically connected to the first sump pump 32 for supply of AC electricity to the first sump pump upon a determination of a need to operate the first sump pump. As mentioned, the sump pump system 12A may include one or more sensors (e.g., 40) and the like for sensing one or more conditions that indicate a need to operate the first sump pump. An example first sensor 40 is shown as a first float switch sensor that will active once a certain level of water is present. Such sensors (e.g., first sensor 40) is/are operatively connected to the controller 60 and the controller used sensory input (e.g., a closing switch upon activation) from the first sensor(s) for control of supply of AC electricity to the first sump pump 32.

The controller 60 may be electrically connected to the battery 52 for controlling maintenance of charge of the battery from of AC electricity. Also, the controller 60 may be electrically connected to the battery 52 and/or the second sump pump 46 for supply of DC electricity to the second sump pump upon a determination of a need to operate the second sump pump. As mentioned, the sump pump system 12A may include one or more sensors (e.g., 50) and the like for sensing one or more conditions that indicate a need to operate the second sump pump 46. An example second sensor 50 is shown as a second float switch sensor that will active once a certain level of water is present. Such sensor(s) (e.g., second sensor 50) is operatively connected to the controller and the controller used sensory input (e.g., a closing switch upon activation) from the second sensor for control of supply of DC electricity to the second sump pump 46.

Figure 3:
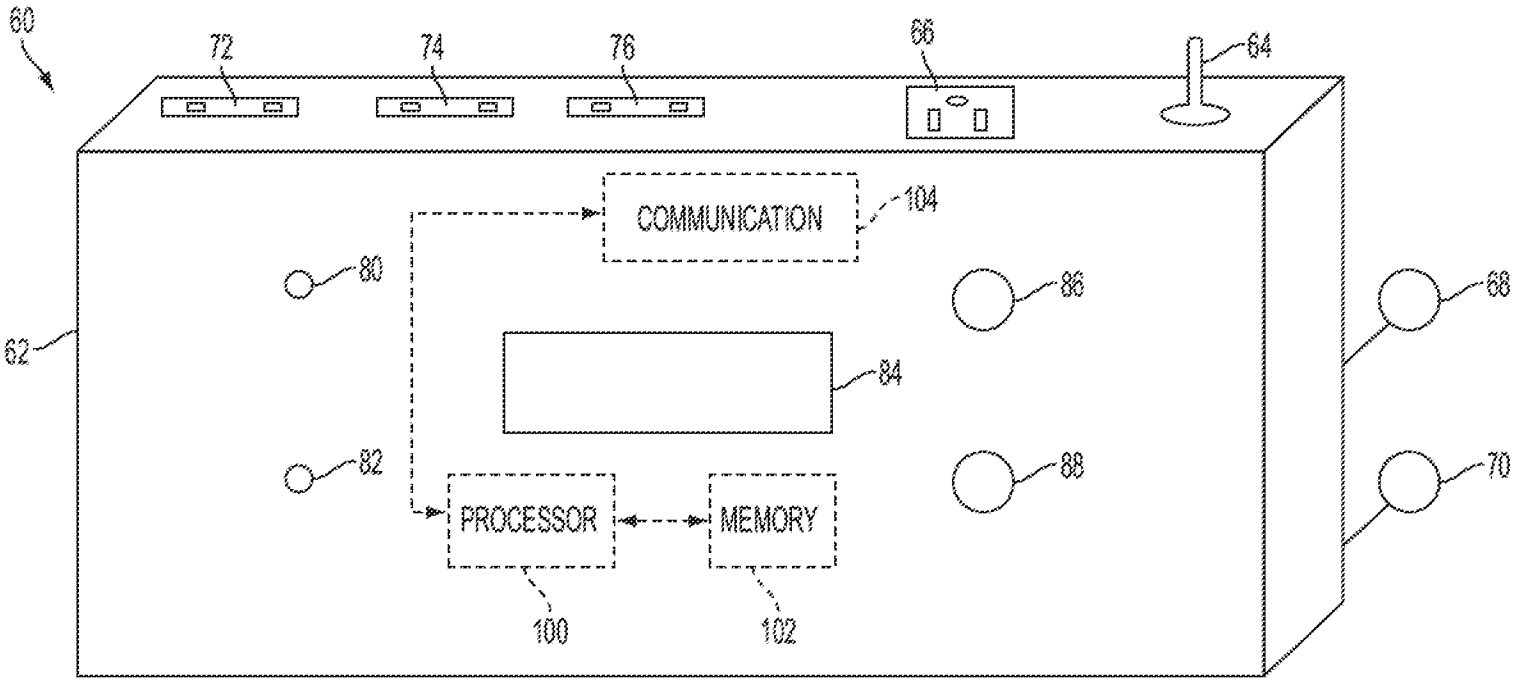
FIG. 3 is a schematic illustration of an example system controller of he sump pump system of FIG. 2.

One example of the controller 60 is schematically shown within FIG. 3. The example controller 60 has a case 62 and is electrically connected to the AC via an AC Cord connection 64. The case 62 includes an AC power outlet 66 for providing controlled electrical power to the first sump pump 32. The case 62 includes connection points 68 and 70 for connection to the battery 52. The case 62 includes a DC power outlet 72 for the second sump pump 46. The case 62 includes various connection points (e.g., 74, 76) for the first sump pump sensor switch 40, the second sump pump sensor switch 50, and various other sensors (e.g., a high water level sensor switch). The example case 62 of the controller 60 also includes a power indicator LED 80, a system monitoring LED 82, an LCD 84 for displaying system information, an actuatable button 86 to cycle through system information presented on the LCD 84, and an actuatable button 88 to silence audible alarms. It is to be appreciated that the type, number, positioning, etc. of the various attributes (e.g., LED, LCD, buttons) could be varied.

The example controller 60 also includes a processor 100 and a memory 102 (both shown in phantom due to location within the case 62). The processor 100 and a memory 102 are operatively connected to be electrically powered as needed. It is to be appreciated that the processor 100 and the memory 102 may have any of a variety of forms and/or formats. For example, the processor 100 may be a computer-related entity, either hardware, a combination of hardware and software, software, or software in execution. For example the processor 100 may be a processor chip running a process, an object, an executable, a thread of execution, a program, and/or a computer. By way of illustration, both an application running on a computer controller and the computer controller can provide the processor 100. One or more components may reside within a processor 100 and/or thread of execution and a component may be localized on one component and/or distributed between two or more components. The processor 100 may include one or more clocks and/or timers. With regard to examples of the memory 102, the memory may include computer-readable storage media involving a tangible device, such as a memory semiconductor (e.g., a semiconductor utilizing static random access memory (SRAM), dynamic random access memory (DRAM), and/or synchronous dynamic random access memory (SDRAM) technologies), a platter of a hard disk drive, a flash memory device, or a magnetic or optical disc (such as a CD-R, DVD-R, or floppy disc). It is thus to be appreciated that the specifics of the processor 100 and/or the memory 102 are within the skill and understanding of the person of ordinary skill in the art and need not be specific limitations.

The example controller 60 also includes a location communication device 104 for interaction (Le., communication) with the communication arrangement 22. The location communication device 104 is operatively connected to be electrically powered as needed. It is to be appreciated that the location communication device 104 may have any of a variety of forms and/or formats. For example, the processor may be a wireless telephone (i.e. cellular) system communicator, a wired telephone system communicator, an internet system communicator, a radio transmission communicator, or the like. Within the shown example, the location communication device 104 is a wireless telephone (i.e. cellular) system communicator that can wirelessly communicate with the communication arrangement 22 (FIG. 1), which within the presented example includes the existing, third party cellular telephone system(s).

The location communication device 104 is operatively connected to the processor 100 and/or the memory 102. As such, the location communication device 104 can convey information between the master device 20 and the processor 100 and/or the memory 102 of the controller 60.

Turning to the master device 20, the master device includes at least one communication device 120, at least one processor 122 and at least one memory 124.

Similar to the location communication device 104 of the controller 60, the communication device 120 of the master device 20 is for interaction (i.e., communication) with the communication arrangement 22 (or even direct communication). It is to be appreciated that the communication device 104 may have any of a variety of forms and/or formats. For example, the communication device 104 may be a wireless telephone (i.e. cellular) system communicator, a wired telephone system communicator, an internet system communicator, a radio transmission communicator, or the like. In view of the example communication arrangement 22 including the existing, third party cellular telephone system(s), the communication device 104 is a telephone based and possibly wireless telephone based.

It is to be appreciated that the at least one processor 122 and the at least one memory 124 may have any of a variety of forms and/or formats. For example, each processor may be a computer-related entity, either hardware, a combination of hardware and software, software, or software in execution. For example each processor may be a processor chip running a process, an object, an executable, a thread of execution, a program, and/or a computer. By way of illustration, both an application running on a controller and the controller can be a processor. One or more components may reside within a process and/or thread of execution and a component may be localized on one component and/or distributed between two or more components. With regard to examples of each memory, the memory may include computer-readable storage media involving a tangible device, such as a memory semiconductor (e.g., a semiconductor utilizing static random access memory (SRAM), dynamic random access memory (DRAM), and/or synchronous dynamic random access memory (SDRAM) technologies), a platter of a hard disk drive, a flash memory device, or a magnetic or optical disc (such as a CD-R, DVD-R, or floppy disc). It is thus to be appreciated that the specifics of each processor and/or memory need not be specific limitations.

The communication between the master device 20 and the processor 100 and/or the memory 102 of the controller 60 provides for use/performance of a method or process that provides operation analysis of operation of the plurality of sump pump systems 12A-12N. It is to be recalled that a plurality of the sump pump systems 12A-12N at the plurality of buildings 14A-14N engage in communication with the master device 20. As will be appreciated, the plurality of the sump pump systems 12A-12N provide a great amount of information (e.g., data) that can be stored, utilized, analyzed, etc. at the master device 20.

It is to be appreciated that the present invention thus provides a method of operation analysis of operation of the plurality of sump pump systems 12A-12N. Each of the plurality of sump pump systems 12A-12N is located at a various, separate location from the others (i.e., the different buildings 14A-14N). A plurality of sensors (e.g., 40, 50, but others possible/contemplated) is respectively associated with the plurality of sump pumps at the separate locations. Each sensor senses at least one operation condition of the respective sump pump. A plurality of location communication devices (e.g., 104) is respectively associated with the plurality of the sump pumps and the sensors at the separate locations. Each location communication device communicates information regarding the sensed at least one operating condition of the respective sump pump. The method includes providing a master communicating device (e.g., 120 of 20) located away from the separate locations. The method includes receiving the communicated information regarding the sensed at least one operating condition of each of the plurality of sump pumps at the master communicating device. The method includes storing the received communicated information for each of the plurality of sump pumps in memory. The method includes determining at least one benchmark value concerning the at least one operating condition utilizing at least most of the received communicated information for each of the plurality of sump pumps. The method includes comparing the received communicated information for each of the plurality of sump pumps to the at least one benchmark value. The method includes classifying each of the plurality of sump pumps based upon each respective comparison (e.g., proper operation, non-proper operation, etc.). In general, such provides for comparative analysis.

It is to be appreciated that the controller 60 can monitor/determine a variety of information concerning pump operation. Accordingly, the controller 60 can store, in memory 102, and transmit, via the location communication device 104, such a variety of information to the master device 20. Also, it is to be appreciated that the master device 20 can monitor/determine a variety of information concerning pump operation based upon information transmitted to the master device. Accordingly, the master device 20 can store, in memory 124, such a variety of information. Moreover, the master device 20 can utilize such stored information for the purpose of further analysis. More specifically, the master device 20 can utilize such stored information regarding a multitude (e.g., some or all) of the sump pumps for the purpose of comparative analysis. A benchmark can be any value that the overall analysis indicates as a desired or otherwise value of interest. As such the benchmark from the overall analysis can be used as a value against which each sensed or determined value from the various sump pumps can be compared or "measured." The master device 20 can still further determine/classify an individual sump pump based upon such comparative analysis.

The information (e.g., data) includes, but is not limited to, the following: total ON cycles of first (e.g., primary) sump pump, total ON cycles of second (e.g., backup) sump pump, total running (i.e., ON) time of first sump pump, total running (i.e., ON) time of second sump pump, time elapsed since last operation of first sump pump, time elapsed since last operation of second sump pump, duration of last operation cycle of first sump pump, duration of last operation cycle of second sump pump, average time elapsed between last two operation cycles of first sump pump ("first pump duty cycle"), average time elapsed between last two operation cycles of second sump pump ("second pump duty cycle"), time since last AC power failure event, duration of last AC power failure event, total count of all AC power failure events, total duration of all AC power failure events, number of operation cycles of second sump pump during last AC power failure event, number of operation cycles of second sump pump during all AC power failure events, current battery voltage, highest recorded battery voltage, lowest recorded battery voltage, and/or number of days since installation. It is to be appreciated that such example information can be sensed/collected/stored/determined/transmitted at any interval/event. However, it is to be appreciated that such and/or other information can be sensed/collected/stored/determined/transmitted at specific intervals/events. Such specific intervals/events may be considered to be anomalies. Examples of such specific intervals/events includes, but is not limited to, the following: loss of A/C power, second sump pump operating while A/C power is available, low battery, critically low battery, high water, high current draw on first sump pump, high current draw on second sump pump, excessive cycle time on first sump pump, and/or excessive cycle time on second sump pump. It is to be appreciated that analysis and storage at the master device is accomplished via the processor and memory, respectively, of the master device.

As mentioned, one aspect that is provided in accordance with an aspect of the present invention is comparative analysis. Because the master device 20 is in communication with a plurality of sump pump systems 12A-12N, and because the master device receives and stores information from the plurality of sump pump systems, the master device can perform the comparative analysis. Such provides for a further aspect that is provided in accordance with an aspect of the present invention, which is/are comparative diagnostics and/or predictive diagnostics. As can be appreciated, comparative diagnostics is directed to analysis review of current operations/conditions and predictive diagnostics is directed to analysis review to predict future operations/conditions. As an example, the master device 20 can compare information data and/or analysis data from one sump pump system (e.g., 12A) to such data (information and/or analysis) for other sump pump systems (e.g., 12B-12N). The comparison(s) may be based upon any one of several factors, such as locality/proximity of other sump pumps, age of other sump pumps, manufacturing brand of other sump pumps. Also, as an example, predictive diagnostics can include predictions such as likelihood of near term pump inoperability (e.g., pump failure), remaining life expectancy term, need for future service/replacement, etc.

The transmitting, receiving, collecting, analyzing and storing of information is successive/repetitive. In particular, the steps of: receiving the communicated information, storing the received communicated information, determining at least one benchmark value, comparing the received communicated information, and classifying each of the plurality of sump pumps are successively repeated. The repeating can provide for iterations (i.e., contestant modification/change as needed). In accordance with one aspect of the present invention, because of the successively repeating to accumulate a collection of information concerning the plurality of sump pumps, may types of information that previously heretofore have not been collected, generated, used, etc. are now collected, generated, used, etc. Again, some examples of such information are: total pump ON cycles, total cumulative ON duration of pump, average amp draw by pump, time elapsed since last pump ON cycle, duration of last pump ON cycle, average time elapsed between last ten pump ON cycles, time since last loss of power to pump occurrence, duration of last loss of power occurrence, total cumulative power loss occurrences, total cumulative duration of all loss of power occurrences, current applied voltage, highest applied voltage, lowest applied voltage, and cumulative duration from pump installation. Many other examples of information are possible and can be collected, generated, used, etc.

In accordance with one aspect of the present invention, the master device 20 can make determinations about contacting the owner or other responsible person associated with the building (e.g., 14A) for the respective sump pump system (e.g., 12A). Also, in accordance with one aspect of the present invention, the master device 20 can contact and notify the owner or other responsible person associated with the building (e.g., 14A) for the respective sump pump system (e.g., 12A)with regard to various matters including alarm messages, perceived needed maintenance, predictive diagnostics, etc. The master device 20 can use the communication arrangement 22 (e.g., telephone, wired or wireless) to provide communication, such as via voice annunciation and/or text message (e.g., Short Message Service or SMS), or other communication format (e.g., email). The master device 20 can even select and utilize a communication format based upon preselected/predefined communication preferences the property owner or other responsible person.

Also, in accordance with one aspect of the present invention, the master device 20 transmit communication to the various, respective sump pump systems (e.g., 12A). The communication can include a variety of information, commands and the like. For example, the master device 20 can send commands to one or more of the sump pump systems (e.g., 12A) so as to change operating parameters at the one or more of the sump pump systems.

It is to be appreciated that within the overall process or method performed within the system, various sub processes or methods can be performed. For example, various processes can be performed at each respective controller and separately at the master device.

Figure 4:
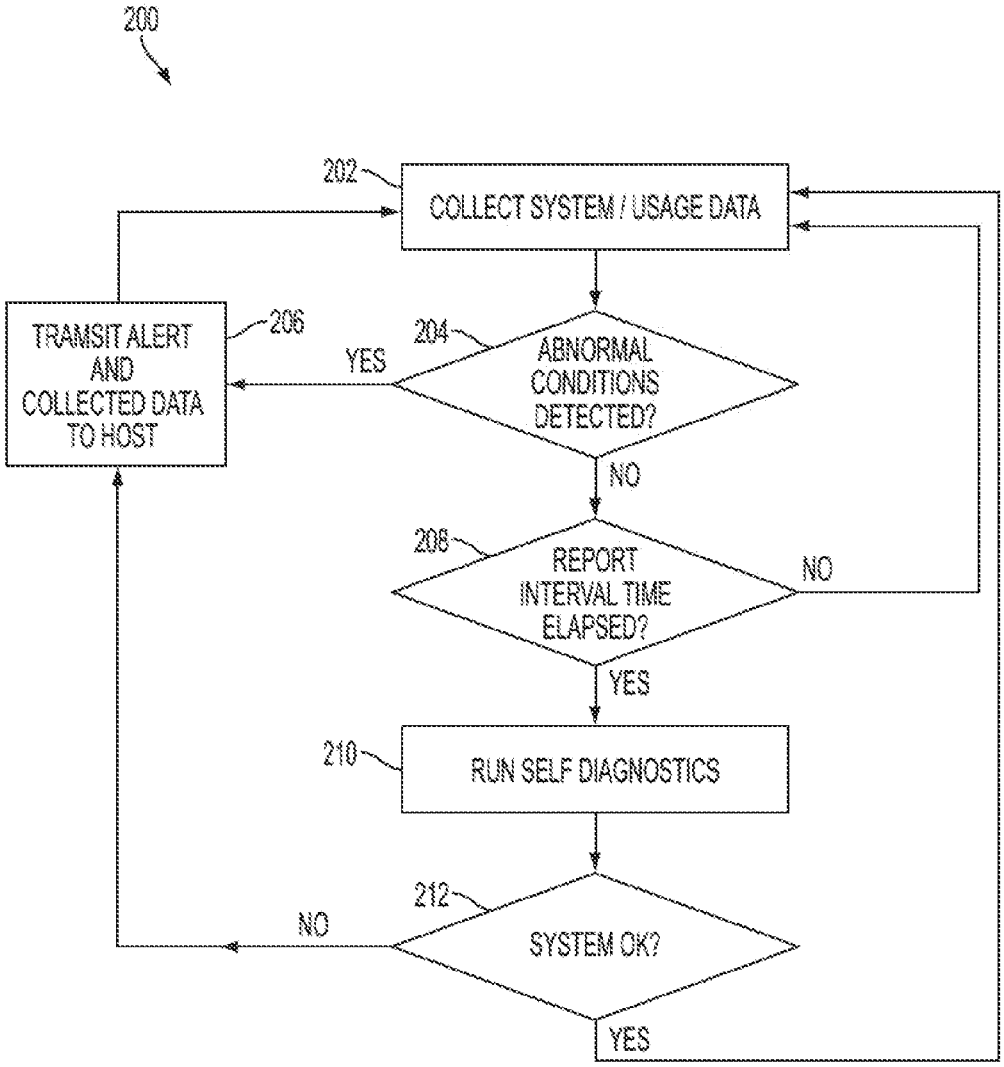
FIG. 4 is a top-level flow chart of an example process performed within the example system controller of FIG. 3.

As one example of a process 200 that can be performed at the controller 60 of each sump pump system (e.g., 12A), reference is made to FIG. 4. The process 200 incudes a step 202 of collecting system/usage data. Such, collection may be via the one or more sensors and/or recording of operational activities performed by the controller. At step 204, it is determined if one or more abnormal conditions are detected. If the determination at step 204 is YES (e.g., an abnormal condition is detected), the process 200 proceeds from step 204 to step 206. At step 206, the processor causes the communication to transmit a message that indicates an alert and can also contain data associated with the determination of the abnormal condition. Once step 206 is complete (i.e., transmission complete), the process 200 proceeds again to step 202 to continue to collect system/usage data.

If the determination at step 204 is NO (e.g., an abnormal condition is not detected), the process 200 proceeds from step 204 to step 208. At step 204, it is determined if a report interval for running a self-diagnostic has elapsed. If the determination at step 208 is NO (e.g., the report interval for running the self-diagnostic has not yet elapsed), the process 200 proceeds from step 208 to step 202 to continue to collect system/usage data.

If the determination at step 208 is YES (e.g., the report interval for running the self-diagnostic has elapsed), the process 200 proceeds from step 208 to step 210. At step 210, the self-diagnostic is performed (e.g., run). Once the self-diagnostic is complete, the process proceeds to step 212. At step 212, it is determined if the system is OK (e.g., no indications of non-proper operation). If the determination at step 212 is YES (e.g., the system is OK), the process 200 proceeds from step 212 to step 202 to continue to collect system/usage data. If the determination at step 212 is NO (e.g., the system is not OK), the process 200 proceeds from step 212 to step 206. At step 206, the processor causes the communication to transmit a message that indicates an alert and can also contain data associated with the determination of the abnormal condition (i.e., system not OK). Once step 206 is complete (i.e., transmission complete), the process 200 proceeds again to step 202 to continue to collect system/usage data.

Figure 5:
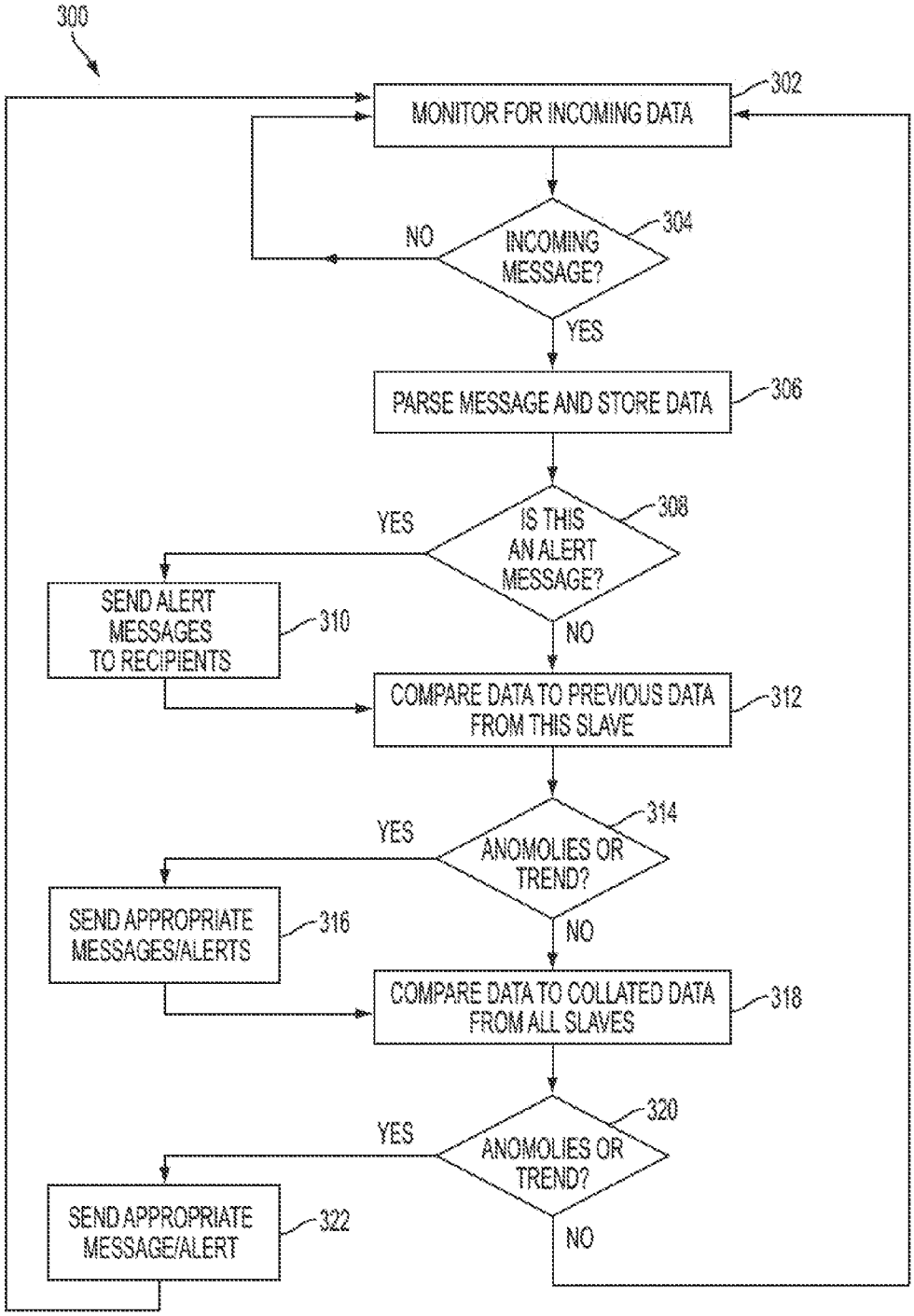
FIG. 5 is a top-level flow chart of an example process performed within the automated system monitoring and data collection arrangement of FIG. 1.

As one example of a process 300 that can be performed at the master device 20, reference is made to FIG. 5. The process 300 incudes a step 302, which is monitoring for incoming data via a transmission message from one the sump pumps. At step 304, the process 300 determines if a transmission message has been received. If the determination at step 304 is NO (e.g., no massage is received), the process 300 loops back to step 302 to monitor for an incoming transmission message. If the determination at step 304 is YES (e.g., a message is received), the process 300 proceeds to step 306. At step 306, the message is parsed and data is stored and needed and in association with a file associated with the sump pump from which the transmission message was received.

The process 300 proceeds from step 306 to step 308. At step 308, the process 300 determines if the received transmission message is an alert message. If the determination at step 308 is YES (e.g., the message is an alert message), the process 300 proceeds to step 310. At step 310, the process 300 causes an alert message to the owner or other responsible person concerning the "alarm" condition that has occurred at the sump pump at the building. Such can be done via transmission of a telephone and/or text (e.g., sms) via the communication arrangement 22. Of course, other communication techniques, formats, etc. could be utilized.

If the determination at step 308 is NO (e.g., the message is not an alert message) or once the step 310 is complete, the process 300 proceeds to step 312. At step, 312, the data received within the receive message is compared to previous data saved within memory for the particular sump pump. Once step 312 is complete (i.e., comparison is complete), the process proceeds to step 314. At step 314, the process determines if any anomalies are present and/or if any trends are perceived. It is to be appreciated that the process could include making determinations about many different anomalies and/or trends. Some examples of trends are increases in pump cycles, decreases in time elapsed since last operation of a pump, increases in duration of pump operation cycle, decreases in average time elapsed between last two operation cycles of pump, decreases in time since last AC power failure event, increases in duration/frequency of AC power failure event, changes in current draw by pump and/or changes in current battery voltage.

If the determination at step 314 is YES (e.g., any anomalies are present and/or any trends are perceived), the process 300 proceeds to step 316. At step 316, the process 300 causes an appropriate message (e.g., message content may vary and level of alert within message may vary) to the owner or other responsible person concerning the anomaly and/or trend at the sump pump at the building. It should be appreciated that steps 312-316 are based upon comparison to data stored for the particular sump pump in accordance with an aspect of the present invention. It is to be appreciated that in accordance with another aspect of the present invention, similar steps can be performed via comparing data information of an individual sump pump to a large/overall collection of data information for some or all of the sump pumps that are (or have been) monitored. As such, if the determination at step 314 is NO (e.g., any anomalies are present and/or any trends are perceived) or the step 316 is completed, the process 300 proceeds to step 318.

At step 318, the data information of an individual sump pump is compared to the large/overall collection of data information for some or all of the sump pumps that are (or have been) monitored. Once step 318 is complete (i.e., comparison is complete), the process proceeds to step 320. At step 320, the process determines if any anomalies are present and/or if any trends are perceived as compared to the large/overall collection of data information. Such the large/overall collection of data information can be utilized as presenting normal or typical operating parameter. Also, the large/overall collection of data information could provide indicators of anomalies and/or trends. It is to be appreciated that the processor could make determinations about many different anomalies and/or trends. Some examples of trends are increases in pump cycles, decreases in time elapsed since last operation of a pump, increases in duration of pump operation cycle, decreases in average time elapsed between last two operation cycles of pump, decreases in time since last AC power failure event, increases in duration/frequency of AC power failure event, changes in current draw by pump and/or changes in current battery voltage.

If the determination at step 320 is YES (e.g., any anomalies are present and/or any trends are perceived), the process 300 proceeds to step 322. At step 322, the process 300 causes an appropriate message (e.g., message content may vary and level of alert within message may vary) to the owner or other responsible person concerning the anomaly and/or trend at the sump pump at the building. Once the step 316 is completed (e.g., the message is sent), the process 300 loops back to step 302 to again monitor for incoming data. Similarly, if the determination at step 314 is NO (e.g., no anomalies are present and/or no trends are perceived) the process 300 loops back to step 302 to again monitor for incoming data.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A method of operation analysis of operation of a plurality of sump pumps, the plurality of sump pumps being located at various, separate locations, a plurality of sensors being respectively associated with the plurality of sump pumps at the separate locations, each sensor sensing at least one operation condition of the respective sump pump, a plurality of location communication devices being respectively associated with the plurality of the sump pumps and the sensors at the separate locations, each location communication device communicating information regarding the sensed at least one operating condition of the respective sump pump, the method including:

providing a master communicating device located away from the separate locations;

receiving the communicated information regarding the sensed at least one operating condition of each of the plurality of sump pumps at the master communicating device;

storing the received communicated information for each of the plurality of sump pumps in memory;

determining at least one benchmark value concerning the at least one operating condition utilizing at least most of the received communicated information for each of the plurality of sump pumps;

comparing the received communicated information for each of the plurality of sump pumps to the at least one benchmark value; and classifying each of the plurality of sump pumps based upon each respective comparison.

2. The method as set forth in claim 1, wherein the step of classifying includes classifying each pump as to likelihood of future operational performance.

3. The method as set forth in claim 2, wherein the step of classifying each pump as to likelihood of future operational performance includes classifying each pump as to likelihood of operational failure.

4. The method as set forth in claim 1, wherein the steps of: receiving the communicated information, storing the received communicated information, determining at least one benchmark value, comparing the received communicated information, and classifying each of the plurality of sump pumps are successively repeated.

5. The method as set forth in claim 1, wherein the step of determining at least one benchmark value is successively repeated via iterations.

6. The method as set forth in claim 1, wherein the step of storing the received communicated information is successively repeated to accumulate a collection of information concerning the plurality of sump pumps.

7. The method as set forth in claim 1, further including conveying the classification for at least some of the plurality of sump pumps.

8. The method as set forth in claim 7, wherein the step of conveying the classification for at least some of the plurality of sump pumps includes conveying the classification for sump pumps having a specific classification.

9. The method as set forth in claim 8, wherein the step of conveying the classification for at least some of the plurality of sump pumps includes conveying the classification for sump pumps having a classification of high likelihood of operational failure in a near term.

10. The method as set forth in claim 1, wherein the communicated information for each of the plurality of sump pumps includes at least one of: cycle ON of pump, ON time duration of pump, amperage draw of pump, voltage applied to pump and loss of power to pump, and the steps of: receiving the communicated information, storing the received communicated information, determining at least one benchmark value, comparing the received communicated information, and classifying each of the plurality of sump pumps utilize such communicated information.

11. The method as set forth in claim 10, wherein the step of storing the received communicated information is successively repeated to accumulate a collection of information concerning the plurality of sump pumps: the method includes determining at least one of the following for each pump: total pump ON cycles, total cumulative ON duration of pump, average amp draw by pump, time elapsed since last pump ON cycle, duration of last pump ON cycle, average time elapsed between last ten pump ON cycles, time since last loss of power to pump occurrence, duration of last loss of power occurrence, total cumulative power loss occurrences, total cumulative duration of all loss of power occurrences, current applied voltage, highest applied voltage, lowest applied voltage, and cumulative duration from pump installation.

12. The method as set forth in claim 1, further including conveying a message concerning a respective sump pump to a person responsible for the respective sump pump.

13. The method as set forth in claim 12, wherein the step of conveying a message includes conveying the message as at least one of telephone message, text message and email message.

14. The method as set forth in claim 12, wherein the step of conveying a message includes conveying the message to include at least one of determined local anomaly, loss of power and sump pump failure.

15. The method as set forth in claim 12, wherein the step of conveying a message includes conveying the message to include at least a prediction of future event.

16. The method as set forth in claim 12, wherein the steps of comparing the received communicated information for each of the plurality of sump pumps to the at least one benchmark value and classifying each of the plurality of sump pumps based upon each respective comparison provides for comparative diagnostics.

17. The method as set forth in claim 12, wherein the steps of comparing the received communicated information for each of the plurality of sump pumps to the at least one benchmark value and classifying each of the plurality of sump pumps based upon each respective comparison provides for predictive diagnostics.

* * * * *